US008777514B2

(12) United States Patent
Heselden

(10) Patent No.: US 8,777,514 B2
(45) **Date of Patent: *Jul. 15, 2014**

(54) GABION

(75) Inventor: James Heselden, Leeds (GB)

(73) Assignee: Hesco Bastion Limited, Leeds, Yorkshire (GB)

( * ) Notice: Subject to any disclaimer, the term of this patent is extended or adjusted under 35 U.S.C. 154(b) by 353 days.

This patent is subject to a terminal disclaimer.

(21) Appl. No.: 12/090,648

(22) PCT Filed: Nov. 1, 2006

(86) PCT No.: PCT/GB2006/050367

§ 371 (c)(1),
(2), (4) Date: May 14, 2008

(87) PCT Pub. No.: WO2007/060476

PCT Pub. Date: May 31, 2007

(65) Prior Publication Data

US 2008/0247830 A1 Oct. 9, 2008

(30) Foreign Application Priority Data

Nov. 24, 2005 (GB) ..... 0523925.6

(51) Int. Cl.
*E02D 29/02* (2006.01)

(52) U.S. Cl.
USPC ..... 405/17; 220/4.29

(58) Field of Classification Search
USPC ..... 52/581; 405/15–17; 220/4.29, 7, 9.2, 220/520, 531, 666
See application file for complete search history.

(56) References Cited

U.S. PATENT DOCUMENTS 4,530,622 A 7/1985 Mercer
5,647,695 A 7/1997 Hilfiker et al.
2005/0284080 A1 * 12/2005 Gallego et al. ..... 52/648.1

FOREIGN PATENT DOCUMENTS

| | | | |
|---|---|---|---|
| EP | 0816572 A | | 1/1998 |
| GB | 1567830 A | | 5/1980 |
| GB | 2359842 A | | 9/2001 |
| GB | 243107 A | | 8/2006 |
| JP | 2003155722 A | * | 5/2003 |
| JP | 2004060207 A | | 2/2004 |

(Continued)

OTHER PUBLICATIONS http://safety.fhwa.dot.gov/geometric/pubs/mitigationstrategies/chapter3/3_1anewidth.htm.*

(Continued)

*Primary Examiner* — Sunil Singh
(74) *Attorney, Agent, or Firm* — Ping Wang; Andrews Kurth LLP

(57) ABSTRACT

The invention concerns a recoverable gabion for use in protecting military or civilian installations from weapons assault or from elemental forces, such as flood waters, lava flows, avalanches, soil instability, slope erosion and the like. The gabion comprises opposed side walls comprising a plurality of side wall elements connected together at spaced intervals by a plurality of partition walls such that spaces between neighboring pairs of partition walls define, together with the side walls, individual compartments of the gabion, adjacent side and partition walls being connected to one another by pivotal connections enabling the gabion to be folded between fully flattened and deployed configurations, wherein at least one of the pivotal connections is a releasable connection which when released allows a side wall element to open with respect to the gabion to allow access from the side of the gabion to any contents of the gabion compartments.

16 Claims, 8 Drawing Sheets

(56) References Cited

FOREIGN PATENT DOCUMENTS

| | | | |
|---|---|---|---|
| WO | 9912160 | A | 10/1990 |
| WO | 0040810 | A | 7/2000 |
| WO | WO 0040810 | A1 * | 7/2000 |
| WO | 2005023453 | A1 | 3/2005 |
| WO | 2005080691 | A | 9/2005 |

OTHER PUBLICATIONS http://www.gabions-mesh.com/info/gabion-basket-sizes.htm.*
International Search Report, International Patent Application No. PCT/GB2006/050367, filed Nov. 1, 2006.
United Kingdom Search Report, Application No. GB0621750.9.

* cited by examiner

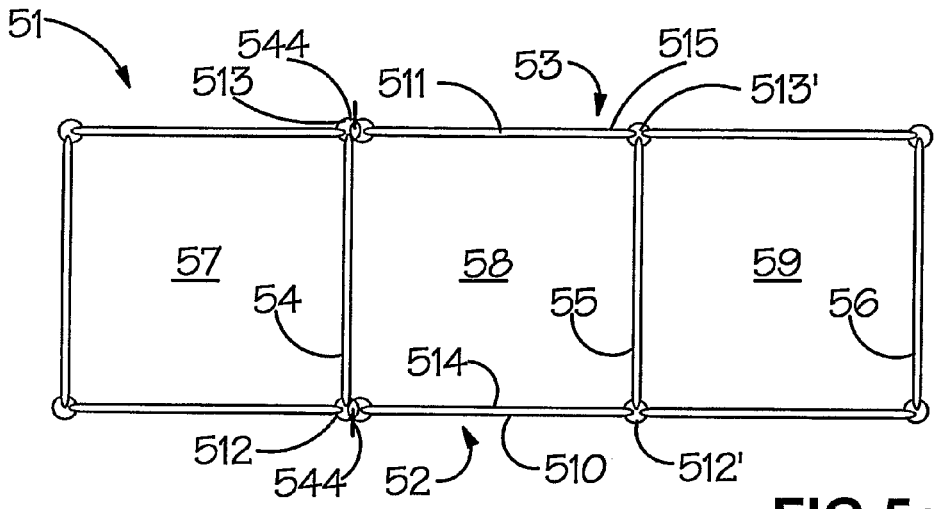
FIG.5a.
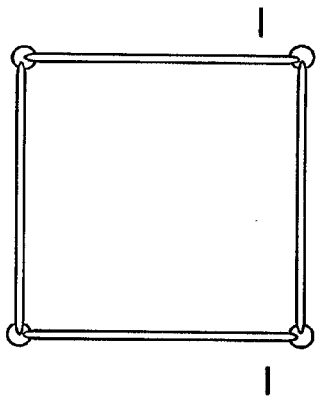
FIG.5b.
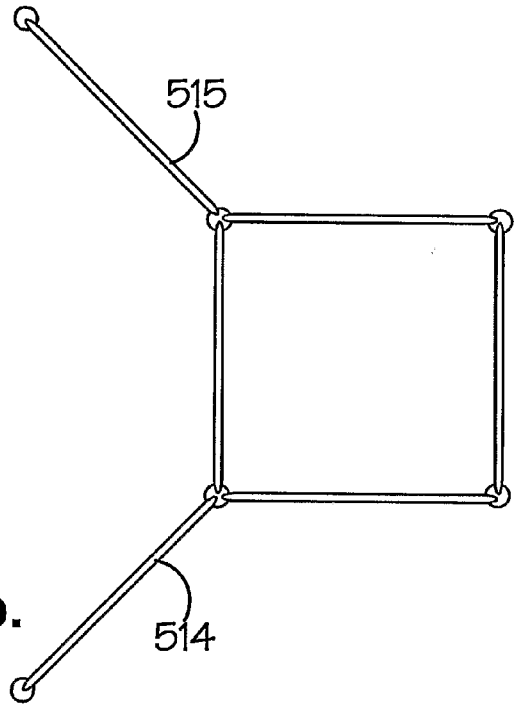
FIG.5c.
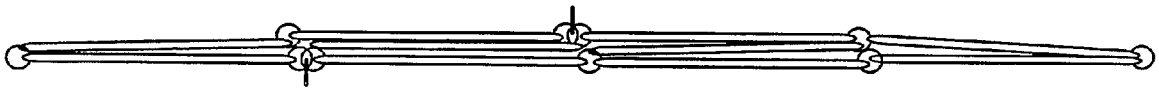

GABION

FIELD

The present invention relates to a gabion, particularly to a multi-compartmental gabion, which can be recovered after use.

BACKGROUND

Gabions are temporary or semi-permanent fortification structures which are used to protect military or civilian installations from weapons assault or from elemental forces, such as flood waters, lava flows, avalanches, slope erosion, soil instability and the like.

WO-A-90/12160 discloses wire mesh cage structures useful as gabions. The cage structure is made up of pivotally interconnected open mesh work frames which are connected together under factory conditions so that the cage can fold concertina-wise to take a flattened form for transportation to site, where it can be erected to take an open multi-compartmental form for filling with a suitable fill material, such as sand, soil, earth or rocks.

WO-A-00/40810 also concerns a multi-compartmental gabion which folds concertina-wise for transportation, and which comprises side walls extending along the length of the multi-compartmental gabion, the side walls being connected at spaced intervals along the length of the gabion by partition walls which are formed from two releasably connected sections, which after use of the gabion can be released, and the gabion unzipped for recovery purposes.

Existing gabions have certain disadvantages with respect to recoverability. For example, recovery of such gabions can be time consuming, difficult, dangerous, impractical, damaging to the gabion material, preventing or compromising its re-use, or a combination of any two or more of these.

Accordingly, there is a need for an improved recoverable gabion. There is also a need for an improved multi-compartmental, recoverable gabion.

DETAILED DESCRIPTION

The present invention provides a gabion comprising opposed side walls comprising a plurality of side wall elements connected together at spaced intervals by a plurality of partition walls such that spaces between neighbouring pairs of partition walls define, together with the side walls, individual compartments of the gabion, adjacent side and partition walls being connected to one another by pivotal connections enabling the gabion to be folded between fully flattened and deployed configurations, wherein at least one of the pivotal connections is a releasable connection which when released allows a side wall element to open with respect to the gabion to allow access from the side of the gabion to any contents of the gabion compartments.

Preferably, the releasable connection comprises a hinge member associated with an edge of each adjacent wall to be connected.

The pivotal interconnection between connected walls and/or wall elements may be achieved by providing interconnected walls and/or wall elements with a row of apertures along an interconnection edge thereof and by providing a coil member helically threaded through a plurality of apertures along the interconnection edge. The each hinge member is preferably a helical spring.

The each releasable connection preferably comprises a releasable locking member releasably securing the hinge members of each pivotable connection to one another. The pivotal connections ideally allow the gabion to fold concertina-wise for storage or transport, for example by causing adjacent walls of the gabion to fold about a plurality of pivot axes. Specifically, the pivot axes may be spaced apart to enable adjacent walls to lie face-to-face when the gabion is in a folded configuration.

The pivotal interconnection between connected side wall elements is preferably releasable by providing the interconnected side wall elements with a row of apertures along an interconnection edge thereof and by providing a first coil member helically threaded through a plurality of apertures along the interconnection edge of a first side wall element, a second coil member helically threaded through a plurality of apertures along the interconnection edge of a second side wall element (connected to the first side wall element along the interconnection edge) and a releasable locking member threaded through overlapped first and second coil members.

One aspect of the present invention provides a multi-compartmental gabion comprising opposed side walls connected together at spaced intervals along the length of the gabion by a plurality of partition walls, at least one side wall comprising a plurality of side wall elements having releasable interconnections which when released allow the side wall elements to open with respect to the gabion to allow access from the side of the gabion to any contents of the gabion compartments.

Another aspect of the present invention provides a multi-compartmental gabion comprising opposed side walls connected together at spaced intervals along the length of the gabion by a plurality of partition walls, the spaces between neighbouring pairs of partition walls defining, together with the side walls, individual compartments of the multi-compartmental gabion, wherein each internal partition wall extends between the side walls and does not comprise any internal releasable connections, individual compartments of the multi-compartmental gabion being bounded by opposed side wall sections of the respective opposed side walls, the partition walls being pivotally connected to the side walls, each end of each internal partition wall being non-releasably pivotally connected to at least one side wall section, and the side wall sections of the individual compartments comprising at least one side wall element, pivotal connections being provided between neighbouring side wall elements allowing the multi-compartmental gabion to fold concertina-wise for storage or transport, the pivotal connection between at least two neighbouring side wall elements being provided by a hinge member provided on one or both neighbouring side wall elements and by a releasable locking member releasably securing the pivotal connection by cooperating with the hinge member, whereby release of the locking member allows a first neighbouring side wall element to be disconnected from a second neighbouring side wall element and for the first side wall element thereby to move pivotally (by means of its pivotal connection with an opposite neighbouring side wall element) with respect to the compartment of the gabion bounded by the first neighbouring side wall element to open said compartment through the side wall of the gabion and allow access to any contents of said compartment.

The multi-compartmental gabion of the invention facilitates post-deployment recovery of the gabion by providing at least one openable side wall section along the length of the gabion. Preferably, a plurality of openable side wall sections are provided. More preferably all of the side wall sections, except those at the ends of the gabion in a gabion having more than two compartments, are openable. Most preferably, all of the side wall sections along the length of the gabion are openable. By "openable" is meant that the pivotal connection between the connected side wall elements of the side wall section is provided by a hinge member provided on one or both of the connected side wall elements and by a releasable locking member cooperating with the hinge member releasably to secure the pivotal connection therebetween. In some preferred embodiments of the invention, a first hinge member is provided on a first neighbouring side wall element and a second hinge member is provided on a second neighbouring side wall element, the releasable locking member cooperating with both the first hinge member and the second hinge member releasably to secure the pivotal connection. Opening of an openable side wall section is achievable by releasing the locking member and pulling apart the resulting unconnected side wall elements.

Each side wall section may comprise a single side wall element, in which case the openable pivotal connection between neighbouring side wall elements is located between neighbouring side wall sections. In this case the pivotal connection between neighbouring side wall elements and the partition wall marking the boundary between corresponding neighbouring side wall sections is also openable to allow the first neighbouring side wall element to be released both from the second neighbouring side wall element and from the partition wall. Alternatively, each side wall section may comprise a plurality of side wall elements, in which case the openable pivotal connection may be provided between neighbouring side wall elements of a given side wall section. However, even when side wall sections comprise a plurality of side wall elements, openable pivotal connections may be provided between neighbouring side wall sections as well as or instead of between neighbouring side wall elements of a given side wall section. Multi-compartmental gabions comprising a plurality of side wall sections, with different numbers of side wall elements constituting different side wall sections are also contemplated.

Deployment of the gabion of the invention will generally be effected by transporting the folded gabion to a deployment site, unfolding the gabion and filling each individual compartment of the gabion with a fill material. Generally the fill material will be dictated at least partly by the availability of suitable materials at the deployment site. Suitable fill materials include, but are not limited to, sand, earth, soil, stones, rocks, rubble, concrete, debris, snow, ice and combinations of two or more thereof.

There are a number of reasons why it could be desirable to open side wall sections of the gabion. For example, when the deployed gabion is to be decommissioned, it is often desirable to recover the gabion for environmental or aesthetic reasons, or simply out of consideration for the local population. Recovery of the gabion of the invention is facilitated by opening up all of the openable side wall sections of the gabion, at least partly removing the fill material from the compartments, and removing the gabion from site.

By way of further example, if the deployed gabion is damaged in use, it may be desirable to replace or repair the damaged section of the gabion. Access via the openable side walls of the damaged section facilitates this. Similarly, when it is desired for reasons unconnected with damage to move, alter or replace a gabion section (for example if the position or orientation of the gabion requires alteration), such replacement is again facilitated by the capacity to remove at will fill material from selected gabion sections.

Although the invention is characterised by the presence of at least one openable side wall section, and preferably by a plurality of openable side wall sections, it will often be desirable to provide each individual compartment of the gabion, optionally with the exception of the end compartments of the gabion (when the gabion has more than two compartments), with openable side wall sections. Accordingly there is provided in accordance with the invention a multi-compartmental gabion as described wherein the pivotal connection between the connected side wall elements of each of the side wall sections, or between each neighbouring side wall section, optionally with the exception of the end side wall sections, is provided by a hinge member provided between the first side wall element of a given side wall section and a second neighbouring side wall element of the given or a neighbouring side wall section, and a releasable locking member cooperating with the hinge member releasably to secure the pivotal connection. Preferably, a first hinge member is provided on the first side wall element and a second hinge member is provided on the second neighbouring side wall element, and the releasable locking member cooperates with both first and second hinge members releasably to secure the pivotal connection.

Furthermore, although a multi-compartmental gabion will be in accordance with the invention if a plurality of openable side wall sections are provided on one side wall, it is also contemplated that openable side wall sections may be provided on both side wall sections of an individual compartment to allow access to the fill material from both sides. Accordingly the invention provides a multi-compartmental gabion as described wherein the pivotal connection between the connected side wall elements of at least a plurality of opposed side wall sections is provided by a hinge member provided between a first side wall element of a given side wall section and a second neighbouring side wall element of the given or a neighbouring side wall section, and by a releasable locking member cooperating with the hinge member releasably to secure the pivotal connection. Also contemplated within the scope of the invention is a multi-compartmental gabion as described wherein the pivotal connection between the connected side wall elements of at least a plurality of opposed side wall sections is provided by a first hinge member provided on a first side wall element of a given side wall section and by a second hinge member on a second side wall element of the given or a neighbouring side wall section and by a releasable locking member connecting the first hinge member to the second hinge member.

Also contemplated is that openable side wall sections may be provided alternately on first and second opposed side walls along at least part of the length of the gabion. In this way when a gabion is being recovered, cooperating excavating equipment or personnel can be deployed on opposite sides of the gabion to remove fill material from neighbouring compartments simultaneously or in rapid succession if simultaneous excavation is undesirable for safety or other reasons. Thus, the invention provides a multi-compartmental gabion as described wherein the pivotal connection between the connected side wall elements of at least a plurality of side wall sections staggered on alternating opposite side walls along at least part of the length of the gabion is provided by a hinge member provided between a first side wall element of a given side wall section and a second neighbouring side wall element of the given or a neighbouring side wall section, and by a releasable locking member cooperating with the hinge member releasably to secure the pivotal connection. Also contemplated within the scope of the invention is a multi-compartmental gabion as described wherein the pivotal connection between the connected side wall elements of at least a plurality of side wall sections staggered on alternating opposite side walls along at least part of the length of the gabion is provided by a first hinge member provided on a first side wall element of a given side wall section and by a second hinge member on a second side wall element of the given side wall section and by a releasable locking member connecting the first hinge member to the second hinge member.

A side wall section preferably comprises a single side wall element, or two side wall elements. However, a side wall section, a plurality of side wall sections, or each side wall section may, if desired comprise more than two side wall elements. In this case pivotal connections are preferably provided between each side wall element. Accordingly the invention provides a multi-compartmental gabion as described wherein one or more side wall sections comprise a single side wall element. The invention also provides a multi-compartmental gabion as described wherein one or more side wall sections comprise two side wall elements pivotally connected together (preferably openably pivotally connected together). Also contemplated within the scope of the invention is a multi-compartmental gabion as described wherein one or more side wall sections comprise more than two side wall elements, with pivotal interconnections being provided between each neighbouring pair of side wall elements.

The multi-compartmental gabion of the invention comprises a plurality of connected compartments, each compartment being bounded at opposed ends by a pair of opposed partition walls, and being bounded at opposed sides by a pair of opposed side wall sections, each side wall section comprising at one side wall element. In at least one, two, three or more individual compartments of the multi-compartmental gabion, at least one such side wall element is arranged to be openable, the mechanism of opening being operable when the compartment is loaded with a fill material.

The concertina-wise folding of the gabion may be effected by the side wall sections folding in towards the central longitudinal axis of the gabion, or by the side wall sections folding out away from the central longitudinal central axis of the gabion. The former manner will generally be preferable as the resulting folded gabion will have a relatively smaller cross-sectional surface area in a plane orthogonal to the central longitudinal axis of the gabion.

In one preferred embodiment of the invention the pivotal interconnection between connected walls and/or wall sections and/or wall elements is achieved by providing interconnected walls, wall sections and/or wall elements with a row of apertures along an interconnection edge thereof and by providing a coil member helically threaded through a plurality of apertures along the interconnection edge. In the case of a straightforward (i.e.—non-openable) pivotal connection, a single coil member may be helically threaded through the connection edge apertures of two (or more) neighbouring walls, wall sections and/or wall elements to achieve pivotal interconnection therebetween. Accordingly, there is provided in accordance with the invention a multi-compartmental gabion as described wherein at least one pivotal connection is provided by the presence of a coil member helically threaded through connection edge apertures of connected walls, wall sections or wall elements.

In another preferred embodiment of the invention the openable pivotal interconnection between connected side wall elements is achieved by providing the interconnected side wall elements with a row of apertures along an interconnection edge thereof and by providing a first coil member helically threaded through a plurality of apertures along the interconnection edge of a first side wall element, a second coil member helically threaded through a plurality of apertures along the interconnection edge of a second side wall element (connected to the first side wall element along the interconnection edge) and a releasable locking member threaded through overlapped first and second coil members. Thus, in the case of an openable pivotal connection, a pair of coil members may be helically threaded through the respective opposed connection edge apertures of two neighbouring side wall elements, and a releasable locking member inserted through the overlapped coils of the opposed pair of coil members. Accordingly, there is provided in accordance with the invention a multi-compartmental gabion as described wherein at least one openable pivotal connection between neighbouring side wall elements is provided by the presence of a pair of coil members helically threaded through respective connection edge apertures of neighbouring side wall elements and by a releasable locking member threaded through the respective coil members when overlapped.

Thus, there is provided in accordance with the invention a multi-compartmental gabion as described wherein the or at least one hinge member comprises a helical coil.

The releasable locking member may be of any suitable shape or size and may for example comprise an elongate locking pin. The pin may be provided with a gripping protrusion at one end to facilitate manual insertion and/or removal of the locking pin. The gripping protrusion may for example comprise a loop at one end of the locking pin. Accordingly there is provided in accordance with the invention a multi-compartmental gabion as described wherein at least one locking member comprises an elongate locking pin.

The side walls, side wall sections, side wall elements and/or partition walls preferably comprise one or more panel sections of any suitable material, for example steel, aluminium, titanium, any other suitable metal or alloy, or from a plastics, ceramic or natural material such as timber, sisal, jute, coir or seagrass. Normally, steel is preferred, in which case the steel is preferably treated to prevent or hinder steel erosion during deployment of the gabion. The panel may be a closed panel or may be a mesh panel. In the case of a closed panel, connection edge apertures where needed will normally be machined or otherwise provided in the panel edge. In the case of a mesh panel the mesh apertures may serve as connection edge apertures where needed.

Preferably, the multi-compartmental gabion of the invention comprises a cage structure.

Also preferably, the gabion comprises pivotally interconnected, preferably open meshwork, panels which are connected together under factory conditions so that the gabion can take a flattened form for transportation to site where it can be erected to take a form in which panels thereof define side, partition and end wails and an open top through which the compartments of the gabion may be filled. Preferably, under factory conditions said panels define side, partition and end walls and are pivotally interconnected edge to edge and are relatively foldable to lie face to face in the flattened form for transportation to site and can be relatively unfolded to bring the gabion to the erected condition without the requirement for any further connection of the side, partition or end walls on site.

In preferred embodiments of the invention, the side walls of the gabion each comprise a plurality of side panels pivotally connected edge to edge and folded concertina fashion one relative to another. The side walls are preferably connected by partition walls which are pivotally connected thereto, the gabion structure being adapted to be erected on site by pulling it apart by the end walls so that when it is moved from the flattened form to the erected condition the side walls unfold and define with the end walls and partition walls an elongated wall structure having a row of cavities to be filled with a fill material and of which each partition wall is common to the pair of cavities adjacent the partition wall.

BRIEF DESCRIPTION OF THE FIGURES

The invention will now be more particularly described with reference to the following drawings, in which:

FIG. 5 shows a schematic plan view of a second form of multi-compartmental gabion in accordance with the invention, wherein each side wall section comprises a single side wall element, in expanded (FIG. 5*a*) and partially folded (FIG. 5*c*) configurations, and in expanded configuration with one compartment opened from both sides (FIG. 5*b*);

Figure 1:
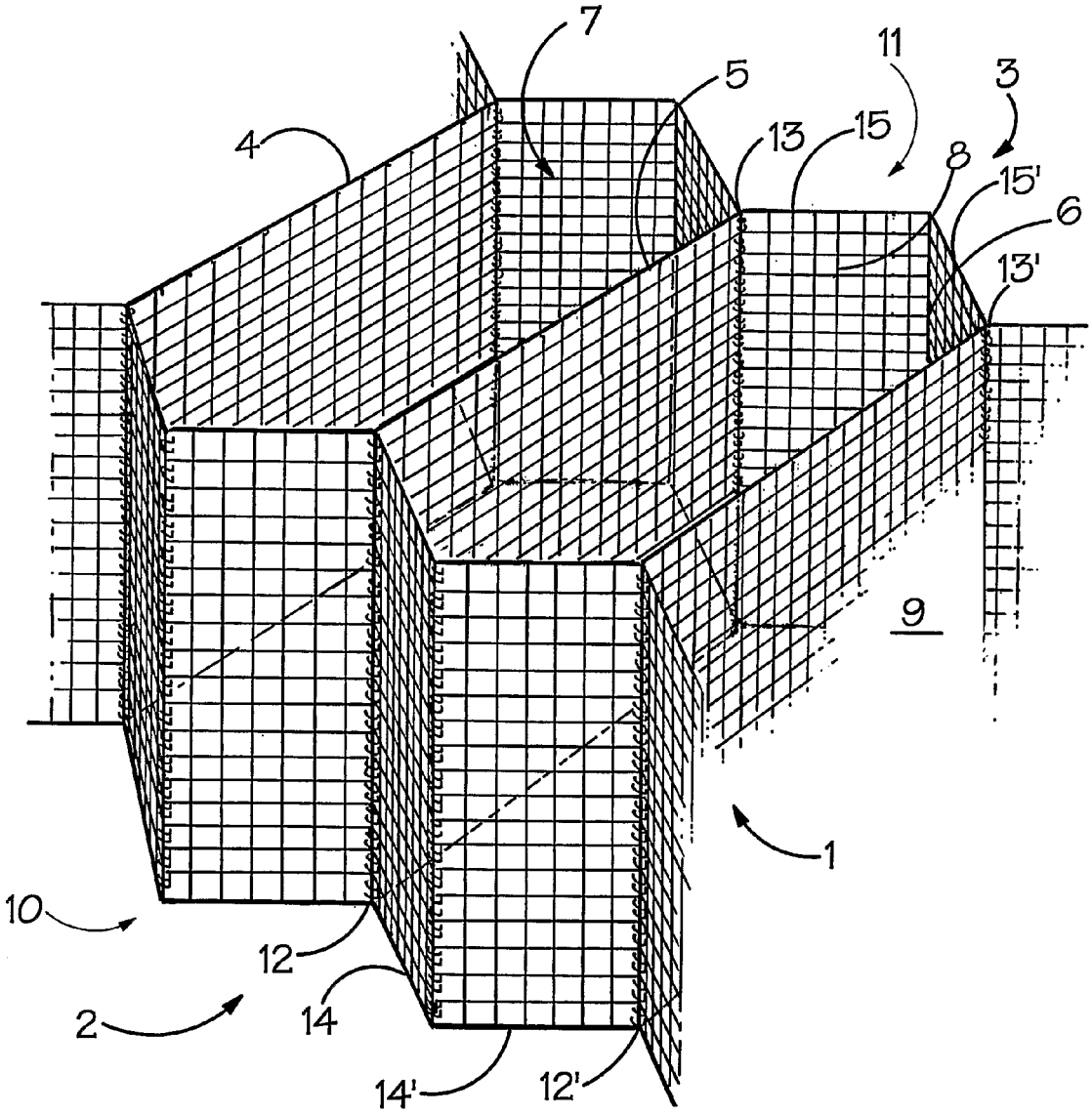
FIG. 1 shows a perspective view of a multi-compartmental gabion in accordance with the invention.
Figure 2:
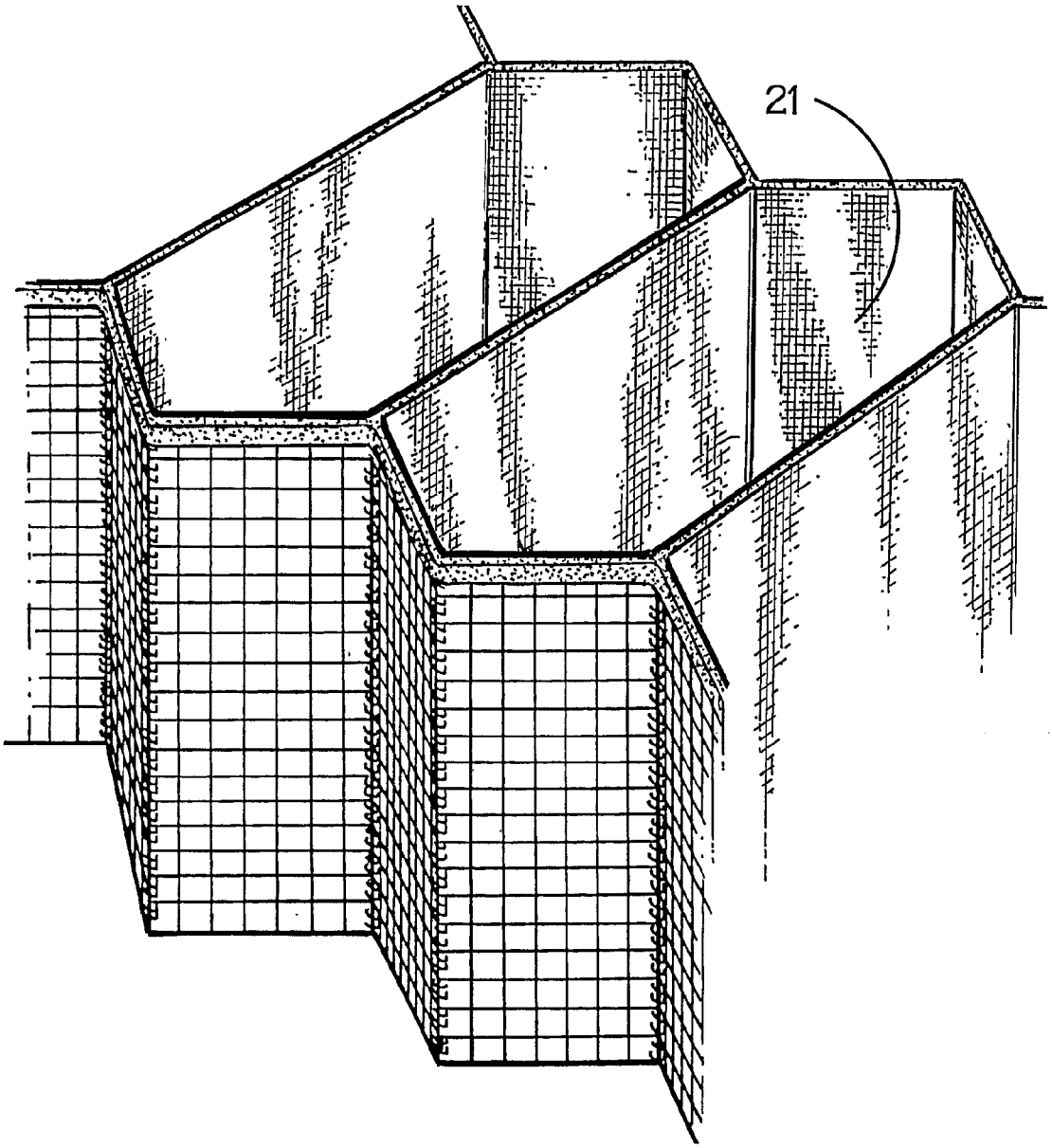
FIG. 2 shows the multi-compartmental gabion of FIG. 1 lined with a geo-textile material.
Figure 3:
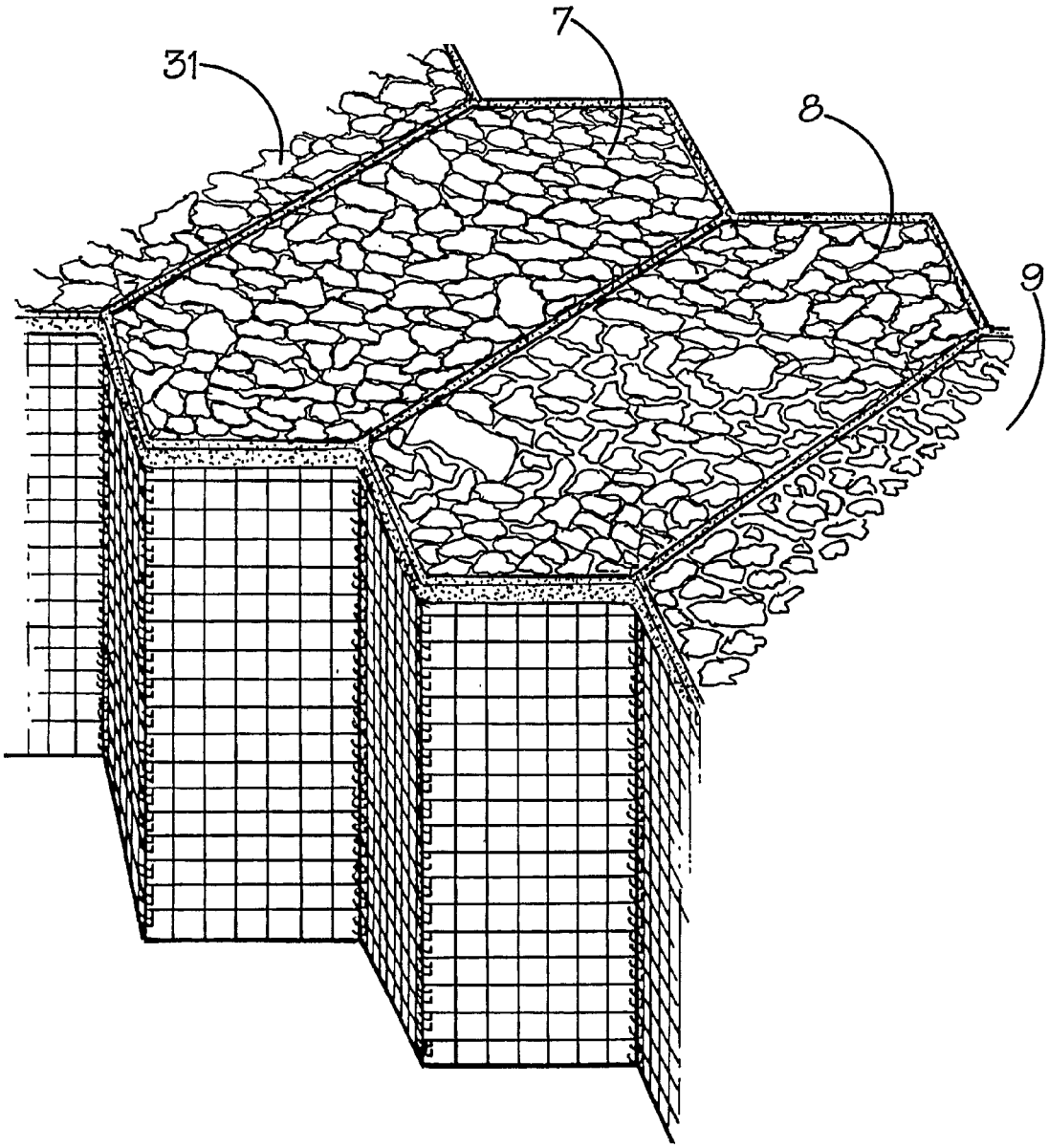
FIG. 3 shows the multi-compartmental gabion of FIG. 2 when filled with a fill material.

Referring in more detail to FIGS. 1, 2 and 3, there is shown multi-compartmental gabion 1 comprising opposed side walls 2, 3 connected together at spaced intervals along the length of gabion 1 by a plurality of partition walls 4, 5, 6 defining, together with side walls 2, 3, individual compartments 7, 8, 9 of multi-compartmental gabion 1. Individual compartment 8 (and other similar individual compartments) of multi-compartmental gabion 1 are bounded by opposed side wall sections 10, 11 of the respective opposed side walls 2, 3. Partition walls 4, 5 (and similar partition walls) are pivotally connected to the side walls 2, 3 at hinge points 12, 12'; 13, 13', each end of each internal partition wall being non-releasably pivotally connected to at least one side wall section.

In the embodiment shown in FIGS. 1, 2 and 3, each side wall section 10, 11 of multi-compartmental gabion 1 comprises two side wall elements 14, 14'; 15, 15' with openable pivotal connections being provided between neighbouring side wall elements 14, 14', and between neighbouring side wall elements 15, 15'.

The pivotal connections between partition walls 4, 5 (and other partition walls in the multi-compartmental gabion) and side walls 2, 3, and the openable pivotal connections between neighbouring side wall elements 14, 14; 15, 15' allow multi-compartmental gabion 1 to fold concertina-wise for flat-packing in transportation and storage. In the embodiment shown in FIGS. 1, 2 and 3, the concertina-wise folding preferably operates so that the openable pivotal connections between neighbouring side wall elements 14, 14'; 15, 15' move inwardly with respect to the longitudinal axis of multi-compartmental gabion 1 so that the width of the flat-packed gabion is at least approximately corresponding to the width of partition walls, 4, 5, 6.

Referring to FIG. 2, multi-compartmental gabion 1 is shown lined with geo-textile liner 21. The lining material of geo-textile liner 21 is of any suitable material, for example woven or non-woven synthetic materials; fibreglass, sisal, jute, coir. In the embodiment shown in FIG. 2, the said lining material is the known geo-textile material sold by Dupont, and which is designed to allow water to pass through the material, but to prevent solid particles which are in a pasty condition from exuding through the material, even although pressed strongly there against. Geo-textile liner 21 may conveniently be folded over the top most edges of the gabion panels and stapled in place (the stapling is not shown in FIG. 2).

Referring to FIG. 3, individual compartments 7, 8, 9 of multi-compartmental gabion 1 are shown filled with fill material 31. Fill material 31 may be selected from any suitable available material, as hereinbefore described. Rough earth and stones are shown as the fill material in FIG. 3.

Figure 4A:
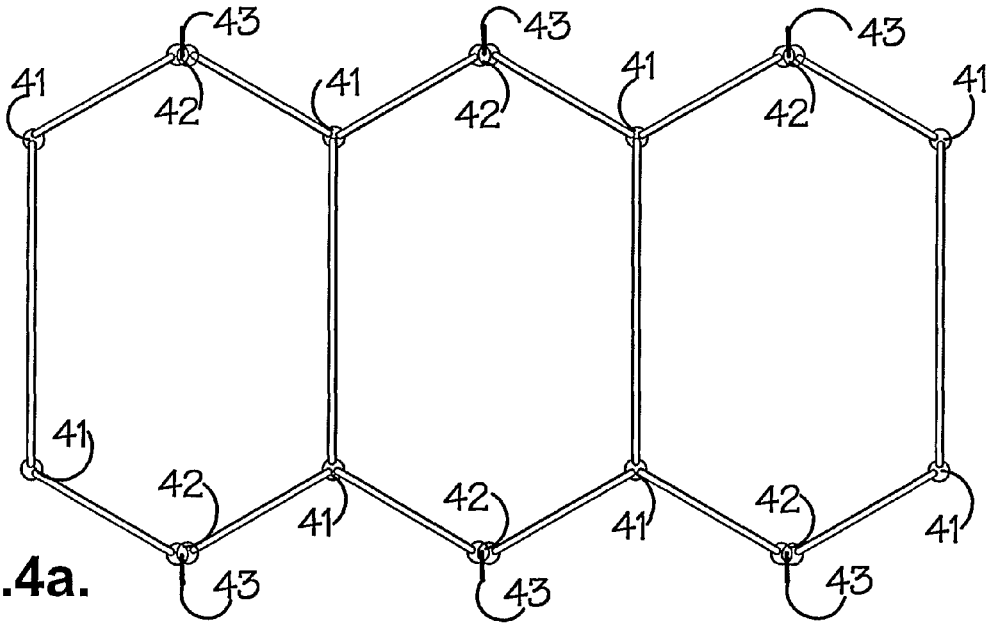
FIG. 4 shows a schematic plan view of the multi-compartmental gabion of FIG. 1 in expanded (FIG. 4*a*), partially folded (FIG. 4*b*) and fully folded (FIG. 4*c*) configurations.
Figure 4B:
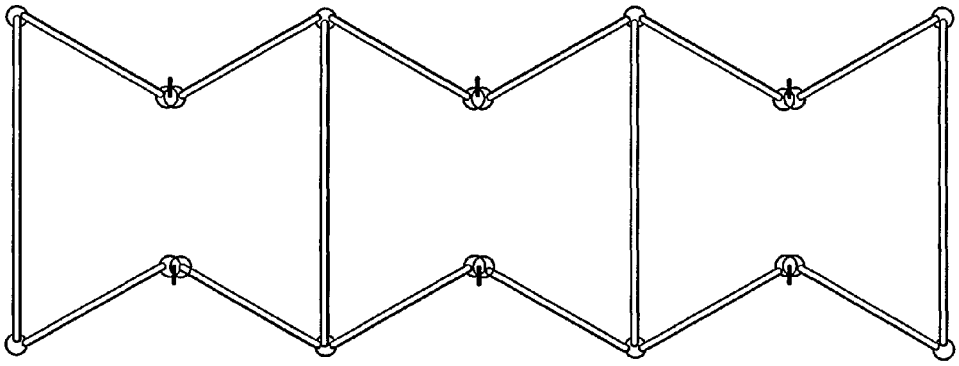
Figure 4C:
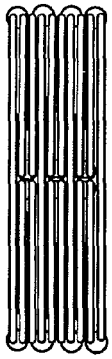

Referring to FIG. 4*a* there is shown in schematic plan view the multi-compartmental gabion in which the pivotal connections between neighbouring compartments are indicated by multiple reference numerals 41, further representative of a pivotal connection between a partition wall and side wall sections of neighbouring compartments, whilst the openable pivotal connections between neighbouring side wall elements are indicated my multiple reference numerals 42. Locking pins 43 may also be seen in FIG. 4*a*. The partially folded gabion is shown in FIG. 4*b*, whilst the fully folded gabion is shown in FIG. 4*c*.

Referring to FIG. 5*a* there is shown in schematic plan view a second form of multi-compartmental gabion 51 comprising opposed side walls 52, 53 connected together at spaced intervals along the length of gabion 51 by a plurality of partition walls 54, 55, 56 defining, together with side walls 52, 53, individual compartments 57, 58, 59 of multi-compartmental gabion 51. Individual compartment 58 (and other similar individual compartments) of multi-compartmental gabion 1 are bounded by opposed side wall sections 510, 511 of the respective opposed side walls 52, 53. Partition walls 54, 55 (and similar partition walls) are pivotally connected to side walls 52, 53 at hinge points 512, 512'; 513, and 513', with 512' and 513' being further representative of a pivotal connection between a partition wall and side wall sections of neighbouring compartments. However, unlike the FIG. 1 gabion, each side wall sections 510, 511 comprises a single side wall element 514, 515, with openable pivotal connections being provided at the junction between the side wall sections and the partition walls, and secured by locking pins 544. FIG. 5*b* shows the gabion when locking pins 544 are removed and side wall elements 514, 515 are moved pivotally to open the gabion compartment 58 from the side. A closed and partially folded configuration of the gabion is shown in FIG. 5*c*. The partially folded gabion shown in FIG. 5*c* may be folded again concertina-wise at the pivot points for flat packing and transportation. In FIG. 5 there is shown an alternative embodiment of a multi-compartmental gabion in accordance with the invention, wherein each side wall section 510, 511 comprises a single side wall element 514, 515. In the embodiment shown in FIG. 5, openable pivotal connections (of the type shown below in FIGS. 7 and 8) are provided between partition wall 55 (and other similar partition walls) and neighbouring side wall elements 514 (and other similar neighbouring side wall elements) and 515 (and other similar neighbouring side wall elements).

Figure 6:
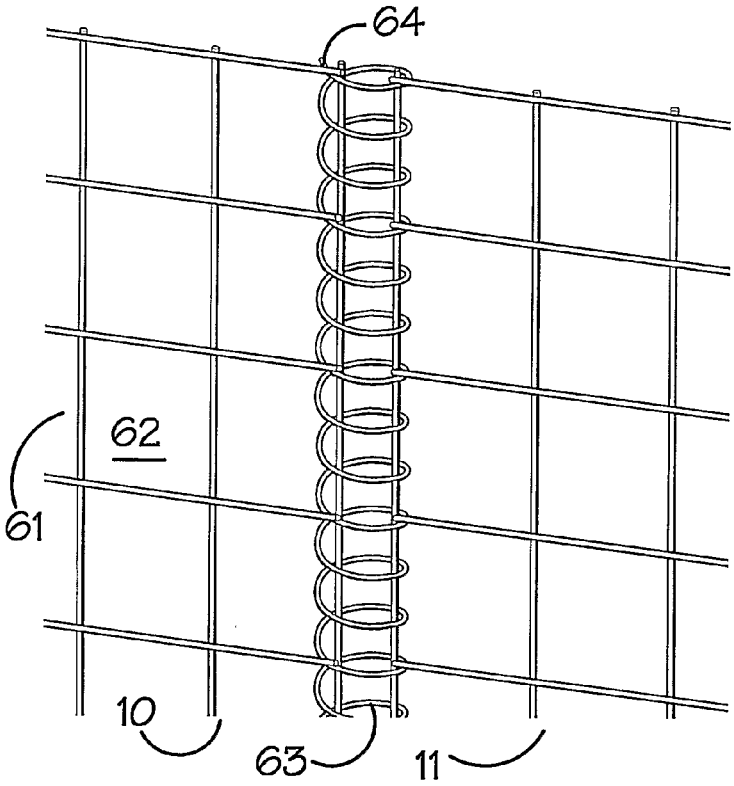
FIG. 6 shows in close-up perspective view the pivotal connection between neighbouring side wall elements of the gabion of FIGS. 1 to 5.

Referring now to FIG. 6 there is shown a close-up perspective view of the pivotal connection between neighbouring side wall sections 10 and 11. For convenience in the drawing, partition wall 5 has been, omitted from the close-up perspective view. However, it will be understood that partition wall 5 also shares in this particular pivotal connection in a similar fashion. Referring to FIG. 6, side wall section 10 comprises an open mesh work panel 61 comprising a mesh work lattice of square apertures 62. Although the entire side wall section is not shown in FIG. 6, the expanded view shows clearly the neighbouring mesh work frames of neighbouring side wall sections 10 and 11. Pivotal connection therebetween is effected by helical coil 63 which is helically threaded through the mesh apertures of the neighbouring panels. Although not shown in FIG. 6, loose end 64 of helical coil 63 may be bent round or otherwise prevented from accidentally disengaging with the top most mesh aperture of side wall section 10, 11 and weakening the pivotal connection by such disengagement.

Figure 7:
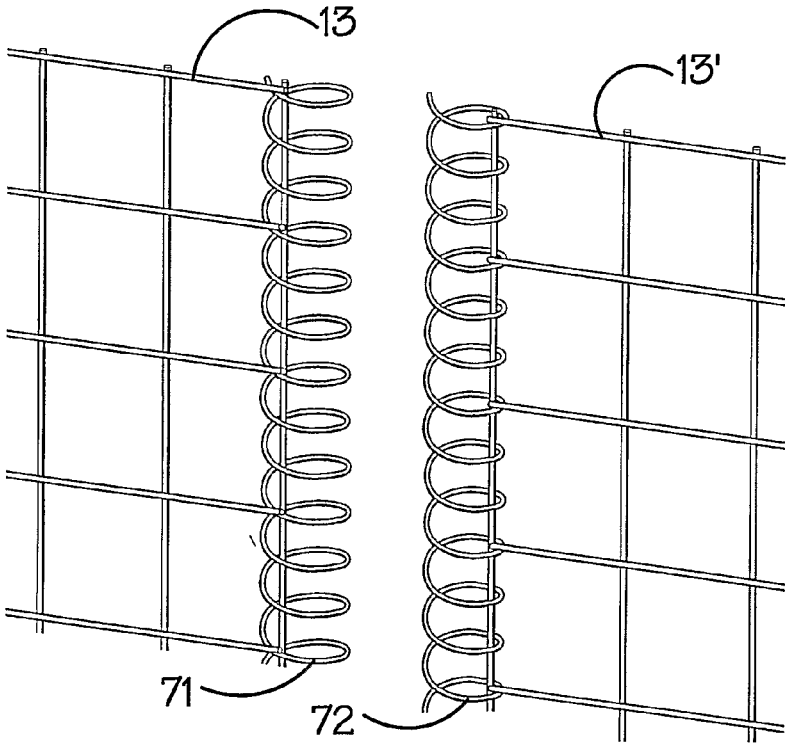
FIG. 7 shows in close-up perspective view the openable pivotal connection between neighbouring side wall elements of the multi-compartmental gabion of FIGS. 1 to 5 before the releasably locking member is installed.
Figure 8:
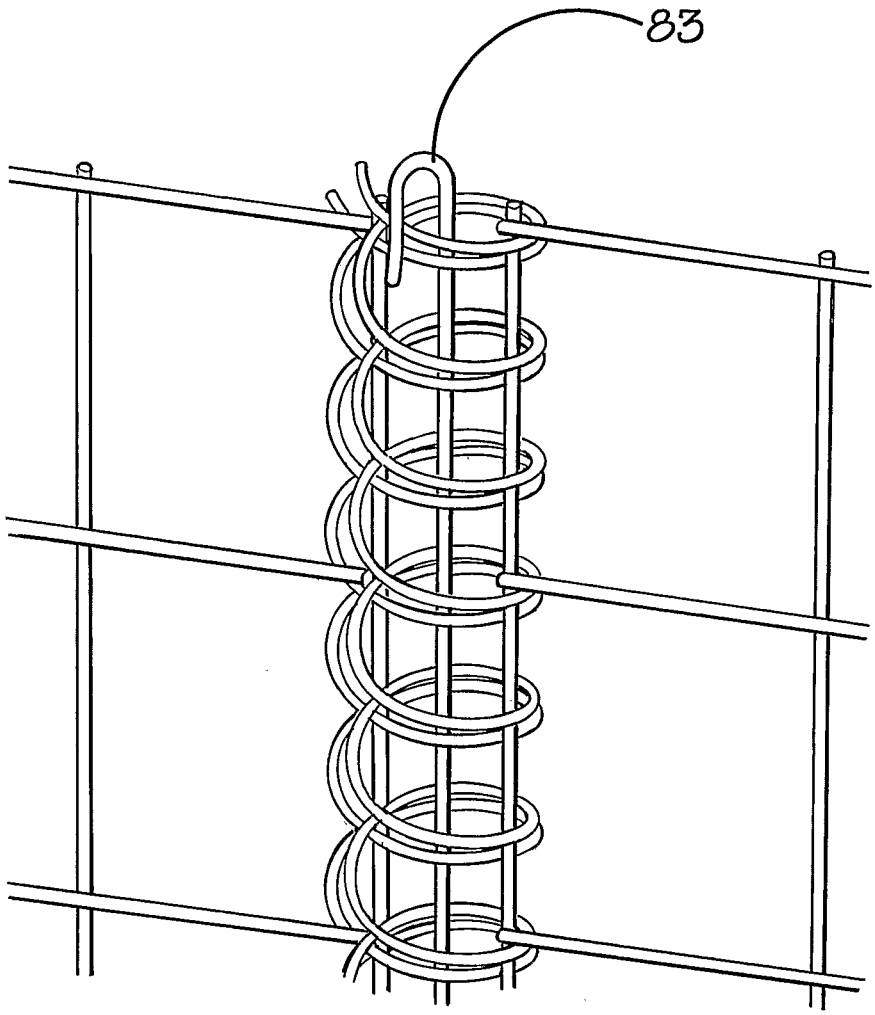
FIG. 8 shows in close-up perspective view the openable pivotal connection when made between the components of the FIG. 7 drawing.

Referring now to FIG. 7, there is shown in close-up perspective view the openable pivotal connection between neighbouring side wall elements 13, 13'. In this case, both neighbouring mesh work panels are provided with helical coil members threaded helically through the mesh work panel apertures thereof. The first hinge member 71 and second member 72 are thereby provided. The connected and releasably locked equivalent is shown in FIG. 8, locking being effected by releasable locking pin 83.

Figure 9:
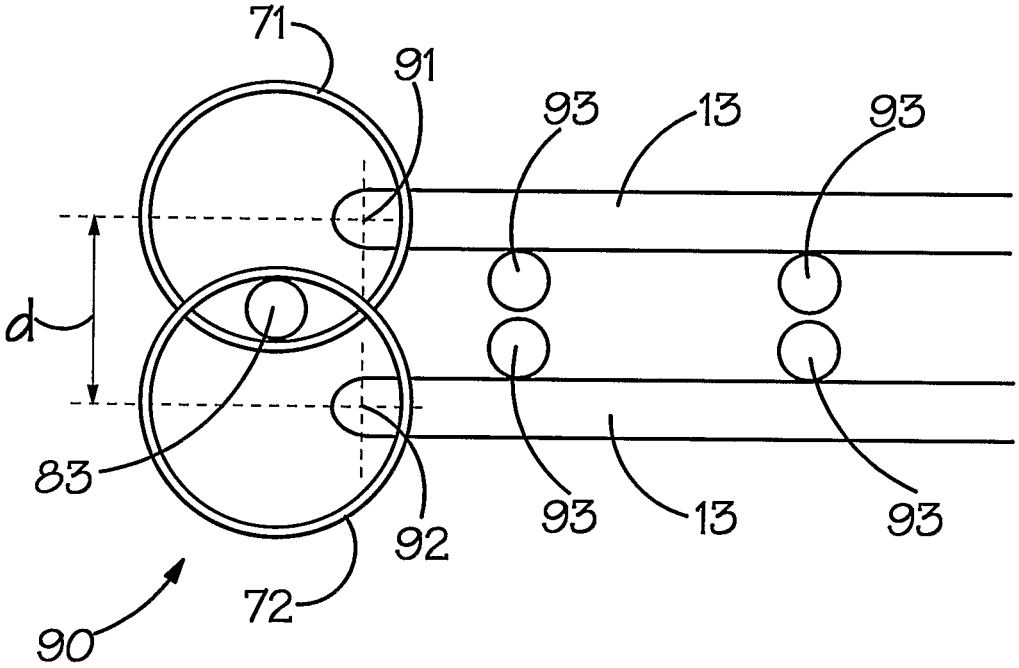
FIG. 9 shows a schematic plan view of a pivotal connection having spaced apart pivot axes.

Finally, FIG. 9 shows how the gabion can be folded substantially flat for storage. The pivotal connection 90 between adjacent, say, side wall elements 13 consists of a pair of helical springs 71, 72 connected by way of a connection member 83 as previously described. This arrangement means that the side wall elements 13 pivot about pivot axes 91, 92 that are spaced apart by a distance d. Distance d is greater than the thickness of the side walls 13 and any protuberances (e.g. vertical wire members 93) such that the side wall elements 13 can lie in a face-to-face relationship to one another.

The invention claimed is:

1. A multi-compartmental gabion comprising:

opposed side walls comprising a plurality of side wall sections each comprising one or more side wall elements, wherein the side walls are connected together at spaced intervals along the length of the gabion by a plurality of partition walls pivotally connected to the side walls, the spaces between neighbouring pairs of partition walls defining, together with the side wall elements of the side walls, individual compartments of the multi-compartmental gabion, wherein each internal partition wall extends between said sidewalls and does not comprise any internal releasable connection, further wherein each end of each internal partition wall is non-releasably pivotally connected to at least one side wall section, wherein said individual compartments of the multi-compartmental gabion are bounded by opposed side wall elements of the respective opposed side walls, and wherein pivotal connections are provided between neighbouring side wall elements allowing the multi-compartmental gabion to fold substantially flat for storage or transport, said pivotal connections comprising a releasable pivotal connection between two neighbouring side wall elements provided by a hinge member provided on each of said two neighbouring side wall elements and by a releasable locking member releasably securing the releasable pivotal connection by cooperating with the hinge member on each of said two neighbouring side wall elements, whereby release of the locking member allows a first one of the neighbouring side wall elements to be disconnected from a second one of the neighbouring side wall elements and for the first neighbouring side wall element thereby to move pivotally, by means of a pivotal connection with another neighbouring side wall element, with respect to the compartment of the gabion bounded by the first neighbouring side wall element to open said compartment through the side wall of the gabion and allow access from the side of the gabion to any contents of said compartment.

2. The gabion according to claim 1, wherein the pivotal connections between the connected side wall elements are achieved by providing interconnected wall elements with a row of apertures along an interconnection edge thereof and by providing a coil member helically threaded through a plurality of apertures along the interconnection edge.

3. The gabion according to claim 2, wherein the coil member is a single coil member helically threaded through the interconnection edge apertures of two neighbouring side wall elements of neighbouring compartments to achieve pivotal connection therebetween.

4. The gabion according to claim 2, wherein the coil member is a helical spring.

5. The gabion according to claim 1, wherein the pivotal connections cause adjacent side wall elements of the gabion to fold about a plurality of pivot axes.

6. The gabion according to claim 5, wherein the pivot axes are spaced apart to enable adjacent walls to lie face-to-face when the gabion is in a folded configuration.

7. The gabion according to claim 1, wherein the releasable pivotal connection between connected side wall elements is achieved by providing the interconnected side wall elements with a row of apertures along an interconnection edge thereof and by providing a first coil member helically threaded through a plurality of apertures along the interconnection edge of said first neighbouring side wall element, a second coil member helically threaded through a plurality of apertures along the interconnection edge of said second neighbouring side wall element, and the releasable locking member threaded through overlapped first and second coil members.

8. The gabion according to claim 1, wherein each side wall section comprises two side wall elements.

9. The gabion according to claim 8, wherein the releasable pivotal connection is provided between neighbouring side wall elements of a given side wall section.

10. The gabion according to claim 8, wherein the releasable pivotal connection is provided between two neighbouring side wall elements of each given side wall section.

11. The gabion according to claim 1, comprising at least a plurality of compartments openable through the side wall.

12. A method for deploying a gabion according to claim 1, comprising transporting the folded gabion to a deployment site, unfolding the gabion and filling each individual compartment of the gabion with a fill material.

13. The method according to claim 12, wherein the fill material is selected from sand, earth, soil, stones, rocks, rubble, concrete, debris, snow, ice and combinations of two or more thereof.

14. A method of recovering a gabion according to claim 1, comprising opening up all of the openable side wall sections of the gabion, at least partly removing the fill material from the compartments, and removing the gabion from site.

15. A method for setting up a barrier against weapons assault or against elemental forces, comprising:

transporting the gabion of claim 1 to a deployment site in a folded configuration;

unfolding the gabion at the deployment site; and filling the individual compartments of the gabion with a fill material.

16. The method of claim 15, wherein said fill material is selected from sand, earth, soil, stones, rocks, rubble, concrete, debris, snow, ice and combinations of two or more thereof.

* * * * *